United States Patent [19]

Koitabashi et al.

[11] 4,350,758

[45] Sep. 21, 1982

[54] PHOTOGRAPHIC EMULSION CONTAINING COPPER HALIDE HOST CRYSTALS

[75] Inventors: Takeo Koitabashi; Syozi Matsuzaka; Toshifumi Iijima; Tetsuya Harada, all of Hino, Japan

[73] Assignee: Konishiroku Photo Industry Co., Ltd., Tokyo, Japan

[21] Appl. No.: 203,513

[22] Filed: Nov. 3, 1980

[30] Foreign Application Priority Data

Nov. 12, 1979 [JP] Japan ..... 54-146739

[51] Int. Cl.[3] ..... G03C 1/02

[52] U.S. Cl. ..... 430/567; 430/564; 430/569; 430/604

[58] Field of Search ..... 430/569, 604, 607, 608, 430/564, 567

[56] References Cited

U.S. PATENT DOCUMENTS

| | | | |
|---|---|---|---|
| 3,178,292 | 4/1965 | Fix | 430/604 |
| 3,219,450 | 11/1965 | Goldberg | 430/604 |
| 4,094,684 | 6/1978 | Maskasky | 430/567 |
| 4,142,900 | 3/1979 | Maskasky | 430/567 |

*Primary Examiner*—Jack P. Brammer

*Attorney, Agent, or Firm*—Frishauf, Holtz, Goodman & Woodward

[57] ABSTRACT

A photographic emulsion containing composite crystals of (a) silver halide and (b) copper halide or a solid solution crystal of copper halide and silver halide is found to be sufficiently photosensitive and developable. In such a photographic emulsion, the amount of silver used can significantly be decreased.

7 Claims, No Drawings

PHOTOGRAPHIC EMULSION CONTAINING COPPER HALIDE HOST CRYSTALS

This invention relates to a novel photographic emulsion. More particularly, the present invention pertains to a photographic emulsion, comprising a copper halide crystal in combination with a silver halide crystal, which is sufficiently photosensitive and developable with a relatively decreased amount of silver halide in the emulsion, thus enabling significant saving of silver metal in photographic technology.

Silver metal, which has been used as starting material for silver halide in photographic emulsions, suffers from scarcity in natural resources. Hence it is very expensive and techniques for saving consumption of silver are earnestly desired.

An object of the present invention is to provide a novel photographic emulsion useful for production of a photographic emulsion in which the amount of silver used can be saved.

Another object of the present invention is to provide a photographic emulsion in which the amount of silver used is saved by use of the novel photographic emulsion.

Still another object of the present invention is to provide a method for preparation of a novel photographic emulsion in which the amount of silver used can be saved.

Other objects of the present invention will become apparent as the description proceeds hereinafter.

The objects of the present invention can be achieved by a photographic emulsion, comprising composite crystals composed of (a) silver halide, and (b) copper halide or solid solution crystal of copper halide and silver halide.

According to a preferred embodiment of the present invention, there is provided a photographic emulsion, wherein the composite crystal comprises a copper halide crystal or a solid solution crystal of a copper halide and a silver halide as host crystal and a silver halide crystal which is epitaxially junctioned onto said host crystal.

I. HOST CRYSTAL

The host crystal useable for the present invention is a copper halide or a solid solution crystal of a copper halide and a silver halide. The host crystals are multifaceted radiation-sensitive crystals, having a mean granular diameter of at least 0.05μ, preferably 0.1 to 5μ, having preferably substantially the zincblende type crystalline structure.

The photographic emulsion comprising copper halide crystals or silver halide-copper halide solid solution crystals according to the present invention (hereinafter referred to as Emulsion A) can be prepared according to the conventional method for preparation of silver halide emulsions by simultaneous mixing, wherein mixing and physical ripening are effected at a P[X] value (wherein [X] represents halogen ion concentration) maintained at 1 to 6.

The Emulsion A can be prepared by, for example, mixing a solution containing copper nitrate (or further silver nitrate about one mole as total amount/liter) with a solution containing potassium halide (about one mole/liter), sodium sulfite ($10^{-4}$ to 1 mole/liter) and about 0.1 to 5% by weight of gelatin as protective colloid by a simultaneous mixing, wherein the halogen of potassium halide is chlorine, bromine, iodine, or a mixture thereof. The obtained crystal is proved to have substantially single crystal structure by means of X-ray diffraction analysis.

In the Emulsion A, there is employed a hydrophilic colloid as protective colloid or binder. Typical examples of the hydrophilic colloid are those conventionally used in the preparation of silver halide emulsions, i.e. natural materials such as gelatin, gelatin derivatives or polysaccharides, synthetic polymers such as water-soluble polyvinyl compounds, etc.

The Emulsion A is used for preparation of a photographic emulsion comprising composite crystals as hereinafter described.

II. COMPOSITE CRYSTALS

According to one embodiment of the present invention, the photographic emulsion contains composite crystals of the host crystal and substantially silver halide crystal, which are combined through a hetero-junction, typically epitaxial junction. In the epitaxially junctioned composite crystals containing copper halide and silver halide according to the present invention, the host crystal, which may be copper halide crystal or a solid solution of copper halide and silver halide, is combined with a silver halide such as silver chloride, silver bromide, silver chlorobromide, silver iodobromide, silver chloroiodobromide or the like through an epitaxial junction. Preferably, the composite crystal comprises host crystals having substantially the zincblende type crystalline structure, and, epitaxially junctioned on said host crystal, crystals substantially consisting of silver halide having substantially the sodium chloride type crystalline structure.

In the present specification, the term "epitaxy" is used to signify the same meaning as described in U.S. Pat. No. 4,094,684 (hereinafter referred to as Reference 1) and U.S. Pat. No. 4,142,900 (hereinafter referred to as Reference 2). Namely, the term "epitaxy" means the crystal orientation of silver halide atoms which is deposited on a host crystal grown under the influence of the host crystal.

The content of the epitaxially junctioned silver halide crystal in the composite crystal is not more than 75 mol %, preferably not more than 50 mol %, based on the total copper halide and silver halide of the composite crystal.

One of the main characteristics of the present invention lies in that the host crystals are the multi-faceted crystals containing copper halide. Another main characteristic lies in the epitaxial junction of silver halide crystal to the above-mentioned host crystals. The employment of the host crystals containing copper halide and epitaxial junction of silver halide thereto can bring about a decrease in amount of the silver required and can also increase the photosensitivity.

The formation of the composite crystals can be done, for instance, by the following processes.

(A) A solution containing a water-soluble halide and a silver salt solution are simultaneously added to the host crystals so that crystals of silver chloride, silver chlorobromide, silver iodobromide, silver chloroiodobromide or the like are deposited through the epitaxial junction.

(B) Crystals of silver chlorobromide, silver chloroiodobromide, silver iodobromide or the like are deposited on the host crystals through epitaxial junction by applying the conversion method stated in, for example, Reference 2.

(C) A solution containing a water-soluble chloride, bromide and/or iodide is added to an emulsion containing the host crystals, water-soluble silver salt and a protective colloid by the single jet method to deposit crystals of silver chloride, silver bromide, silver chlorobromide, silver iodobromide, silver chloroiodobromide or the like through the epitaxial junction.

(D) A solution containing a water-soluble silver salt is added to an emulsion containing the host crystal, a water-soluble halide and a protective colloid by the single jet method to deposit a crystal such as silver chloride, silver bromide, silver chlorobromide, silver iodobromide, silver chloroiodobromide through the epitaxial junction.

The photographic emulsion having the composite crystal of the invention can be coated and dried on an appropriate support to prepare a silver halide emulsion layer, exposed imagewise by an actinic ray and developed under an appropriate developing condition to yield a photographic silver image.

The photographic emulsion having the composite crystal of the present invention shows preferred interimage and edge effects. The host crystals consisting of copper halide or silver halide-copper halide solid solution have a sensitivity not lower than that of the silver iodide crystals disclosed in References 1 and 2. The second portion of each of the composite crystals, that is a portion formed on the host crystal of the above solid solution through epitaxial junction, consists substantially of a silver halide crystal. The term "substantially" herein mentioned means that there may also be contained other atoms than these silver halides, as far as they do not impair the characteristics of the photographic emulsion. As such other atoms, there may be included the copper atoms to be incorporated into the epitaxial crystal from the host crystal during preparation steps.

In the epitaxial composite crystals, the host crystal serves as a radiation-receptor. If the photographic emulsion containing composite crystals of the present invention are exposed imagewise to UV or a blue light, a developable latent image is formed. If the epitaxial composite crystals are exposed, the epitaxial silver halide crystal portions are made developable.

The host crystal in the composite crystal of the present invention has optimum amount and composition which are to be determined depending on the uses of the photographic emulsion having the composite crystal. For example, when it is desired to save the amount of silver to be used, there may be employed a copper halide crystal of a solid solution crystal containing not less than 80 mol % of copper halide based on total silver halide and copper halide of the host crystal. On the other hand, when a high photosensitivity is necessary, there may be employed a solid solution crystal containing 1 to 80 mol % of copper halide based on total silver halide and copper halide of the host crystal. When chlorine or bromine atoms are contained in a host solid solution crystal as the silver halide or copper halide, copper halide of the host crystal is preferably more than 70 mol % based on the total host crystal.

In the host crystal, the copper halide and silver halide preferably have a common halide component, e.g. copper chloride and silver chloride; copper chlorobromide and silver chlorobromide; etc.

Photosensitivity of the solid solution crystal containing copper iodide and silver iodide, which is in the form of thin film prepared by evaporation, may be attributable to the capacity of said solid solution absorbing radiations with longer wavelengths as compared with silver iodide, as disclosed in Phys. Rev. 129(1), (1963), p.69–78, by M. Cardona.

The epitaxial silver halide portion of the composite crystal does not serve as the radiation receptor in the composite crystal. Accordingly, the photographic speed of the photographic emulsion of the present invention is not predominently controlled by radiation given to the epitaxial silver halide.

The optimum amount and composition of the epitaxial silver halide used for the present invention can be selected according to the purpose of the photographic emulsion of the present invention. For instance, if characteristics in which the exposure level to radiation is high and the developing speed is high are required, the epitaxial silver halide at a higher ratio is employed, as compared with a case in which lower exposure level to radiation and lower developing speed are required. If an improvement on the storage stability of the composite silver halide emulsion is particularly intended, epitaxial silver halide containing silver bromide or silver iodide is employed. If the emulsion is to be subjected to a combined developing, bleaching and fixing treatment, an epitaxial silver halide composition is optionally selected so that the balance among the developing speed, the bleaching speed and the fixing speed can be advantageously controlled.

The epitaxial silver halide crystal employed for the present invention makes the composite crystals reactive to the surface development. Namely, the photographic emulsion of the present invention can be developed in a surface developing solution after imagewise exposure. The surface developing solution contains substantially no soluble iodide salt and silver halide solvent, and can initiate development of a latent image being present on the facet of the silver halide crystal.

Preferable epitaxial silver halide of the composite crystal deposited onto the host crystal is AgCl, AgBr, AgClBr or AgClBrI ($I<7$ mol %). The host crystal and the epitaxial crystal have preferable common halide component, e.g. CuCl/AgCl, CuAgCl/AgCl, CuBr/AgBr, CuClBrI/AgClBrI, CuAgBrI/AgBrI, etc. Practically, important combinations of the host crystal and the epitaxial crystal are CuCl/AgCl, CuBr/AgBr, CuClBr/AgClBr, CuI/AgClBr and CuI/AgClBrI.

The composite crystals employed for the present invention can be so formed that a latent image can be made present inside of the crystal structure rather than present on the crystal structure facets upon exposure. In other words, the epitaxial composite silver halide crystals included in the present invention can be so formed as to become crystals for forming an internal latent image predominantly. To predispose the composite crystals form an internal latent image, an internal dopant can be incorporated into the epitaxial silver halide crystal. Examples of the internal dopant include silver, sulfur, iridium, gold, platinum, osmium, rhodium, tellurium, selenium, etc. The photographic emulsion containing the composite crystals according to the present invention can be developed, for instance, with an internal developing solution containing a silver halide solvent or a soluble iodide. When the composite crystals for forming predominently an internal latent image are prepared, the epitaxial silver halide crystals are formed in the presence of, for instance, a non-silver metal ion, preferably a polyvalent metal ion. The epitaxial silver halide crystals are preferably formed in the presence of the water-soluble salts of the respective metal, most preferably in an acidic medium. Preferred examples of the polyvalent metal ions include divalent metal ions such as lead ions, trivalent metal ions such as antimony, bismuth, arsenic, gold, iridium, rhodium and the like and tetravalent metal ions such as iridium and the like. Particularly preferred polyvalent metal ions to be employed are iridium, bismuth and lead ions. The epitaxial silver halide crystals generally contain at least $10^{-9}$ mole %, preferably at least $10^{-6}$ mole % of the internal dopant based on the epitaxial silver halide. The dopants are generally present in the epitaxial silver halide grain in a concentration of less than about $10^{-1}$ mole, preferably $10^{-4}$ mole, per mole of epitaxial silver halide.

The composite crystals employed for the present invention can be prepared by depositing epitaxial silver halide crystal on facets of copper halide crystals or silver halide-copper halide solid solution crystals serving as the host crystals, for instance, in one of the methods (A), (B), (C) and (D) described hereinbefore. Preparation of silver halide-copper halide solid solution crystal is also possible according to the methods as shown in Examples 2 and 3 shown below in addition to the foregoing methods.

The photographic silver halide emulsion of the present invention can be blended with other emulsions so as to obtain specified photographic characteristics. This procedure enables control of both photographic sensitivity and contrast. If the photographic silver halide emulsion of the present invention comprises the composite crystals specified by the present invention and other silver halide crystals blended therewith and if the composite crystals occupy at least 50% by weight of the total silver halide crystals, the composite crystals mainly participate in the formation of image. Even though the amount of the composite crystals is less than 50% by weight, the interimage effect and edge effect can be effectively controlled.

In the present invention, the composite crystals specified by the present invention can be blended with silver chloride crystals. An advantageous aspect of the incorporation of silver chloride crystals lies in that the developing speed and/or the silver image density can be substantially enhanced due to the physical development of the silver chloride crystals, even though the silver chloride crystals are not developed chemically or directly under the conditions specified for exposure and development. The ratio for blending the composite silver halide crystals specified by the present invention with the silver chloride crystals can be optionally selected depending upon the purpose. If a prominent effect is desired to be achieved in the solution physical development, 1–50% by weight, particularly 5–50% by weight, of the total silver halide content is preferably occupied by the silver chloride blended with the composite crystals specified by the present invention.

As the protective colloid or binder to be used in the composite crystal photographic emulsion according to the present invention, there may be used those conventionally used in silver halide emulsions.

A photographic emulsion of the present invention can be coated on an appropriate support to provide a photographic silver halide photosensitive material. Into a photographic emulsion of the present invention or a photographic photosensitive material, a variety of photographic additives can be incorporated in the manners described in References 1 and 2. There can be incorporated, for instance, a sensitizing dye, coupler, development controlling agent, antifoggant, stabilizer, developing agent, film hardening agent, antistatic agent, plasticizer, lubricating agent, bleaching agent, ultra violet absorber, antihalation dye, and filter dye, as desired.

A photographic emulsion of the present invention is advantageously applied to a variety of light-sensitive silver halide photographic materials such as those for X-ray, color, black-and-white, transfer process, high contrast photography and photothermography.

The photographic emulsion of the present invention can be chemically sensitized in a conventional manner. Applicable chemical sensitizing agents and examples of preferred sensitizing processes are described in Research Disclosure No. 176, 17643 page 22–33 (hereinafter referred to as Reference 3). The photographic emulsion of the present invention can be spectrally sensitized by applying a sensitizing dye which is used in the conventional silver halide emulsion.

Further, examples of development processes for a photographic photosensitive material employing the photographic emulsion of the present invention are described in Reference 3. For instance, the light-sensitive silver halide photographic material can be processed through a conventional physical development process or can be subjected to a transfer process generally employed, such as the colloid transfer process, silver salt diffusion transfer process, inhibition transfer process, color transfer process, etc.

The photographic emulsion of the present invention is advantageously applicable to a redox amplification process requiring a heterogeneous catalyst for enabling the reaction between an oxidizing agent and a reducing agent. Examples of the oxidizing agent and reducing agent and concrete procedures are described in References 1 and 2. The photographic emulsion of the present invention can be applied to a thermosensitive light-sensitive photographic material, as described in these References.

The conventional process such as bleaching, bleach-fixing, fixing or water-washing may also be employed for the photographic material using emulsion of the present invention in the same way as the conventional silver halide photographic material.

As described above, the photographic emulsion of the present invention may be formulated into a composite crystal photographic emulsion in which the solid solution crystal is combined through the epitaxial junction with silver halide. With such a constitution, the amount of silver used can advantageously be decreased with increased photosensitivity, as compared with a well-known silver halide emulsion comprising the composite silver halide crystals having silver halide epitaxially junction onto a part of the facets of multi-faceted crystals of silver iodide.

The present invention is further illustrated by the following examples, but these examples should not be construed to limit the present invention.

EXAMPLE 1

A monodispersed silver iodide emulsion was prepared employing the three solutions set forth in Table 1.

TABLE 1

| | | |
|---|---|---|
| Solution A | Ossein gelatin | 100.0 g. |

TABLE 1-continued

| | | |
|---|---|---|
| | Distilled water | 3.0 l. |
| | KI | 2.23 g. |
| | Temperature | 35° C. |
| | pH | 6.0 |
| Solution B | 5 molar aqueous solution of KI | 1,000 ml. |
| Solution C | 5 molar aqueous solution of $AgNO_3$ | 800 ml. |

An iodine ion electrode and a double-junction type silver/silver chloride reference electrode (junction solution: 1 molar $KNO_3$ aqueous solution) sold on the market were immersed in Solution A to measure the potential. The potential (−175 mV) was maintained during addition of Solutions B and C by adjusting the flow rate of Solution B.

Solution C was added at a constant flow rate of 0.5 ml./min. during the initial 6 min. period, and subsequently the flow rate was elevated straight forwardly by a rate of 0.385 ml./min. per every 10 min. The complete addition of Solution C required 197 min., and the temperature of the solution was kept at 35° C. during the physical aging procedure. When the addition of Solution C was complete, the addition was discontinued. Subsequently, washing with water and desalting were carried out in the following manner.

A precipitant [5% aqueous solution of Demol N® (polymethylenebis-sodium naphthalene sulfonate), produced by Kao Atlas Co., Ltd., Japan] and an aqueous solution of magnesium sulphate (20%) were added in a ratio of 10:9 until a precipitate was produced. The precipitate was allowed to stand quietly to form a sediment, and then the supernatant liquid was removed by decantation. To the sedimented precipitate was added 3,000 ml. of distilled water to disperse again the precipitate. An aqueous solution of magnesium sulfate (20%) was further added to the so obtained disperse system until a precipitate was again produced. After sedimentation of the precipitate was complete, the supernatant liquid was removed by decantation. The aqueous solution of ossein gelatin containing 56.6 g. of gelatin was added to the precipitate, and the precipitate was dispersed under stirring at 35° C. for 20 min. Then, distilled water was so added to the disperse system to make the total volume to be 2,270 ml. The so obtained emulsion is referred to hereinafter as EM-1. The mean diameter of the grains contained in the EM-1 emulsion and the standard deviation of the granular diameter were confirmed to be 0.25 μm and 20% of the mean granular diameter respectively upon observation of the electron microscope photograph. Moreover, the X-ray diffraction analysis indicated that the EM-1 emulsion consisted substantially of β-phase silver iodide with little amounts of those of α- and γ-phases.

EXAMPLE 2

An emulsion comprising fine AgCuI crystals containing 15 mole % of CuI was prepared employing the three solutions set forth in Table 2.

TABLE 2

| | | |
|---|---|---|
| Solution D: | Ossein gelatin | 30 g. |
| | $Na_2SO_3$ | 120 g. |
| | KI | 19.8 g. |
| | Distilled water | 3,000 ml. |
| | Ethanolic aqueous solution of sodium salt of polyisopropylene-polyethylenoxy-disuccinate (10%) | 1.5 ml. |
| Solution E: | $AgNO_3$ | 144.4 g. |

TABLE 2-continued

| | | |
|---|---|---|
| | $Cu(NO_3)_2 3H_2O$ | 34.5 g. |
| | Water added to make up | 1,000 ml. |
| Solution F: | KI | 166 g. |
| | Ossein gelatin | 20 g. |
| | Water added to make up | 1,000 ml. |

An iodide ion electrode and a double-junction type saturated silver/silver chloride reference electrode (junction solution: 1 molar $KNO_3$ aqueous solution) sold on the market were immersed in Solution D to measure the potential. Solutions E and F were added to Solution D under adjustment of a flow rate of Solution E to maintain the potential constantly at −190 mV during the addition of Solutions E and F. The rate of addition of Solution E was controlled constantly at 3.13 ml./min. for one to two minutes from the beginning of the addition, thereafter increased linearly at the rate of 2.41 ml./min. per two minutes. It took 40 minutes before all of Solution E was added. Washing with water and desalting were conducted similarly as in Example 1, followed by re-dispersion in a gelatin solution. This emulsion is hereinafter referred to as EM-2.

EXAMPLE 3

Using the three solutions set forth in Table 3, there was prepared an emulsion in which pure silver chloride was epitaxially grown on silver iodide as prepared in Example 1.

TABLE 3

| | | |
|---|---|---|
| Solution G: | Ossein gelatin | 4.4 g. |
| | KCl | 1.0 g. |
| | Em-1 emulsion | 160 ml. |
| | Distilled water | 840 ml. |
| Solution H: | One molar $AgNO_3$ aqueous solution | |
| Solution I: | One molar KCl aqueous solution | |

There were added 70.6 ml. of Solution H and 70.6 ml. of Solution I to Solution G at 35° C. simultaneously over 6 minutes according to the double-jet method. After completion of the addition, washing with water and desalting were conducted according to the following procedure. A precipitant (5% aqueous solution of Demol N, produced by Kao Atlas Co., Ltd., Japan) and an aqueous solution of magnesium sulphate (20%) were added in a ratio of 10:9 until a precipitate was produced. The precipitate was allowed to stand quietly to form a sediment, and then the supernatant liquid was removed by decantation. To the sedimented precipitate was added 800 ml. of distilled water to disperse again the precipitate. An aqueous solution of magnesium sulfate (20%) was further added to the so obtained disperse system until a precipitate was again produced. After sedimentation of the precipitate was complete, the supernatant liquid was removed by decantation. The aqueous solution of ossein gelatin containing 10 g. of gelatin was added to the precipitate, and the precipitate was dispersed under stirring at 35° C. for 20 minutes. Then distilled water was added to the disperse system to make a total volume to 200 ml. The so obtained emulsion is hereinafter referred to as EM-3.

EXAMPLE 4

According to the method similar to Example 3, by replacing EM-1 in Solution G in Table 3 with EM-2, there was prepared an emulsion in which AgCl was epitaxially junctioned on AgCuI. The so obtained emulsion is hereinafter referred to as EM-4.

EXAMPLE 5

The emulsions EM-1 and EM-2 which had not yet been chemically sensitized were coated on film supports, respectively, in the amounts of gelatin of 4.00 g/m$^2$ and the sum of silver and copper of 0.046 mol/m$^2$ (Sample Nos. 1 and 2). These samples were exposed to white light through an optical wedge in a KS-1 type Sensitometer (manufactured by Konishiroku Photo. Ind. Co., Ltd., Japan), and then treated in the developing solution having the following composition at 20° C. for 10 minutes, followed by fixation treatment and washing with water.

| Developing solution | |
|---|---|
| Metol | 6 g. |
| Sodium sulfite (anhydrous) | 50 g. |
| Hydroquinone | 6 g. |
| Sodium carbonate | 29.5 g. |
| Potassium bromide | 1.0 g. |
| Add water to make | 1 liter |

The results obtained upon sensitometry are set forth in Table 4.

TABLE 4

| Sample No. | EM No. | Relative sensitivity | $D_{min.}$ | $D_{max.}$ |
|---|---|---|---|---|
| 1 | 1 | No | 0.03 | 0.08 |
| 2 | 2 | No | 0.03 | 0.08 |

Note:
Relative sensitivity was determined at $D_{min.}$ + 0.10. No means that the determination was not possible.

As seen from the results shown in Table 4, EM-2 and EM-1 show extremely low photographic reactions.

EXAMPLE 6

To each of the silver halide emulsions of EM-3 and EM-4 was added $2.0\times10^{-5}$ mole of sodium thiosulfate and $1.0\times10^{-5}$ mole of sodium chloroaurate per mole of each emulsion, and the mixture was stirred at 45° C. for 60 minutes. Subsequently, to the resulting mixture were added 4-hydroxy-6-methyl-1,3,3a,7-tetraazaindene and 1-phenyl-5-mercaptotetrazole, and bis(vinylsulfonylmethyl) ether and saponin were further added thereto just prior to being coated. The mixture was then coated on a support in amounts of 0.028 mole/m$^2$ and 2.0 g/m$^2$ of gelatin to prepare samples (Sample Nos. 4 and 5). The amount of the coating was adjusted so that the total moles of silver halide and copper halide may be equal per unit area. These samples were exposed to white light through an optical wedge in a KS-1 type Sensitometer (manufactured by Konishiroku Photo. Ind. Co., Ltd., Japan), and then subjected to the treatment similarly as described in Example 5. The results are set forth in Table 5.

TABLE 5

| Sample No. | EM No. | Relative sensitivity | $D_{min.}$ | $D_{max.}$ | Relative amount of silver coated |
|---|---|---|---|---|---|
| 4 | EM-3 | 100 | 0.03 | 0.50 | 100 |

TABLE 5-continued

| Sample No. | EM No. | Relative sensitivity | $D_{min.}$ | $D_{max.}$ | Relative amount of silver coated |
|---|---|---|---|---|---|
| 5 | EM-4 | 120 | 0.02 | 0.50 | 65 |

Notes:
(1) Relative sensitivity was measured at $D_{min.}$ + 0.10.
(2) Relative amount of silver coated means the relative value of the amounts of silver halide coated per unit area.

As apparently seen from the results shown in Table 5, the photographic emulsion according to the present invention EM-4 (Sample No. 5), as compared with the known photographic emulsion EM-3 (Sample No. 4), is not lowered in sensitivity in spite of decreased amounts of silver, but there can be seen rather a substantial increase in sensitivity.

EXAMPLE 7

A pure copper bromide emulsion was prepared using the three solutions set forth in Table 6.

TABLE 6

| | | |
|---|---|---|
| Solution J: | Acid treated gelatin (isoelectric point: 7.5) | 10.0 g. |
| | KBr | 59.6 g. |
| | $Cu(NO_3)_2.3H_2O$ | 120.8 g. |
| | Distilled water added to make up 500 ml. of solution | |
| Solution K: | $Na_2SO_3.7H_2O$ | 31.5 g. |
| | Distilled water added to make up 250 ml. of solution | |
| Solution L: | Acid treated gelatin (isoelectric point: 7.5) | 5.0 g. |
| | Distilled water added to make up 500 ml. of solution | |

After the solution L was adjusted to pH 2.0 by addition of $HNO_3$ at 40° C., the solutions J and K were added by the double jet method over 40 minutes to the solution L.

After completion of the addition, desalting and redispersing steps were conducted in the same manner as in Example 3, except for maintaining the pH during the steps acidic in the range from 2 to 3 and using an acid treated gelatin as dispersant gelatin, to prepare an emulsion containing fine copper bromide grains dispersed in gelatin.

This emulsion is hereinafter referred to as EM-5. As the result of X-ray diffraction, EM-5 was found to consist of pure copper bromide.

EXAMPLE 8

A pure copper chloride emulsion was prepared according to the same procedure as described in Example 7 except that 59.6 g. of KBr in Solution L was replaced with 18.64 g. of KCl. This emulsion is hereinafter referred to as EM-6. As the result of X-ray diffraction, EM-6 was found to consist of pure copper chloride.

EXAMPLE 9

Using the three solutions as shown in Table 7, there was prepared an emulsion of composite crystal wherein pure silver bromide was epitaxially grown onto the copper bromide as prepared in Example 7.

TABLE 7

| | | |
|---|---|---|
| Solution M: | Acid treated gelatin | 4.4 g. |
| | KBr | 1.0 g. |
| | EM-7 emulsion | 160 ml. |
| | Distilled water | 840 ml. |

TABLE 7-continued

| | |
|---|---|
| Solution N: | 1 M aqueous $AgNO_3$ solution |
| Solution O: | 1 M aqueous KBr solution |

After the solution M was adjusted to pH 2.0 by addition of $HNO_3$ at 35° C., 70.6 ml. of the solution N and 70.6 ml. of the solution O were simultaneously added over 6 minutes to the solution M. After completion of the addition, desalting and re-dispersing steps were conducted similarly as in Example 7.

The thus prepared emulsion is hereinafter referred to as "EM-7".

EXAMPLE 10

An emulsion of a composite crystal wherein pure silver chloride was grown onto copper chloride was prepared according to the same procedure as in Example 9 except that the solutions M and O shown in Table 7 were replaced with the solutions P and Q, respectively, as shown in Table 8. This emulsion is hereinafter referred to as "EM-8".

TABLE 8

| | | |
|---|---|---|
| Solution P: | Acid treated gelatin | 4.4 g. |
| | KCl | 1.0 g. |
| | EM-8 emulsion | 160 ml. |
| | Distilled water | 840 ml. |
| Solution Q: | 1 M aqueous KCl solution | |

EXAMPLE 11

The emulsions EM-5 and EM-6 which had not yet been chemically sensitized were treated similarly as in Example 5 to give samples No. 5 and No. 6. The results of sensitometry measured for these samples are shown in Table 9.

TABLE 9

| Sample No. | EM No. | Relative sensitivity | $D_{min.}$ | $D_{max.}$ |
|---|---|---|---|---|
| 5 | 5 | No | 0.03 | 0.05 |
| 6 | 6 | No | 0.03 | 0.05 |

As apparently seen from the results shown in Table 9, EM-5 and EM-6 exhibit photographic reactions very similar to EM-1.

EXAMPLE 12

Each of silver halide photographic emulsions EM-7 and EM-8 was treated similarly as in Example 6. Table 10 shows the results of sensitometry of the samples No. 7 and No. 8 obtained.

TABLE 10

| Sample No. | EM No. | Relative sensitivity | $D_{min.}$ | $D_{max.}$ |
|---|---|---|---|---|
| 7 | 7 | 100 | 0.02 | 0.50 |
| 8 | 8 | 100 | 0.02 | 0.50 |

We claim:

1. A photographic gelatin silver halide emulsion comprising a composite crystal consisting essentially of (A) (i) a solid solution crystal of a copper halide and a silver halide or (ii) a copper halide, as a host crystal having a mean granular diameter of at least 0.05μ, and (B) a silver halide which is epitaxially junctioned onto said host crystal.

2. The photographic gelatin silver halide emulsion of claim 1 wherein said host crystal is a solid solution crystal containing not less than 1 mol % of copper halide based on the total solid solution crystal.

3. The photographic gelatin silver halide emulsion of claim 1 or 2 wherein said host crystal contains a copper halide selected from the group consisting of copper iodide, copper bromide and copper chloride.

4. The photographic gelatin silver halide emulsion of claim 1 or 2 wherein said epitaxially junctioned silver halide is selected from the group consisting of silver chloride, silver bromide, silver chlorobromide, silver iodobromide and silver chloroiodobromide.

5. The photographic gelatin silver halide emulsion of claim 4 wherein said epitaxially junctioned silver halide is selected from the group consisting of silver chloride, silver bromide, silver chlorobromide, silver iodobromide and silver chloroiodobromide.

6. The photographic gelatin silver halide emulsion of claim 3 wherein said host crystal is a copper halide.

7. The photographic gelatin silver halide emulsion of claim 3 wherein said host crystal is a solid solution crystal of a copper halide and a silver halide.

* * * * *